United States Patent [19]

Zodrow

[11] Patent Number: 4,457,801

[45] Date of Patent: Jul. 3, 1984

[54] LABELING STATION FOR ARTICLES LIKE BOTTLES

[75] Inventor: Rudolf Zodrow, Düsseldorf, Fed. Rep. of Germany

[73] Assignee: Jagenberg Aktiengesellschaft, Dusseldorf, Fed. Rep. of Germany

[21] Appl. No.: 466,278

[22] Filed: Feb. 14, 1983

[30] Foreign Application Priority Data

Feb. 16, 1982 [DE] Fed. Rep. of Germany ..... 3205414
Apr. 3, 1982 [DE] Fed. Rep. of Germany ..... 3212509

[51] Int. Cl.[3] ..... B65C 9/10; B65C 9/16

[52] U.S. Cl. ..... 156/364; 156/565; 156/568; 156/571; 156/DIG. 29; 156/DIG. 32; 271/33; 271/124; 271/136; 271/137

[58] Field of Search ..... 156/364, 564, 565, 568, 156/570, 571, 572, 573, DIG. 29, DIG. 30, DIG. 31, DIG. 32; 271/99, 33, 122, 124, 126, 136, 137, 138

[56] References Cited

U.S. PATENT DOCUMENTS

| | | | |
|---|---|---|---|
| 2,269,870 | 1/1942 | Carter | 156/571 |
| 3,822,163 | 7/1974 | Bilotti | 156/571 |
| 4,293,365 | 10/1981 | Geyser et al. | 156/568 |

*Primary Examiner*—Michael G. Wityshyn
*Attorney, Agent, or Firm*—Sprung, Horn, Kramer & Woods

[57] ABSTRACT

An improvement in a labeling station for bottles having pivoting extractors 2, 3, 4 with convex pickup surfaces, means for applying adhesive to the extractors and means for rolling the extractors over a stack of labels so as to pick up the front-most label which is thereafter supplied to a gripping cylinder, all in conventional manner. In accordance with the invention the labels are present as stacks in a magazine which can be moved from operative to inoperative position by holders which are activated only in the intervals between label removals so that the magazine can be moved to inoperative position when there is a gap in the supply of bottles going through the station.

20 Claims, 7 Drawing Figures

LABELING STATION FOR ARTICLES LIKE BOTTLES

Figure 1:
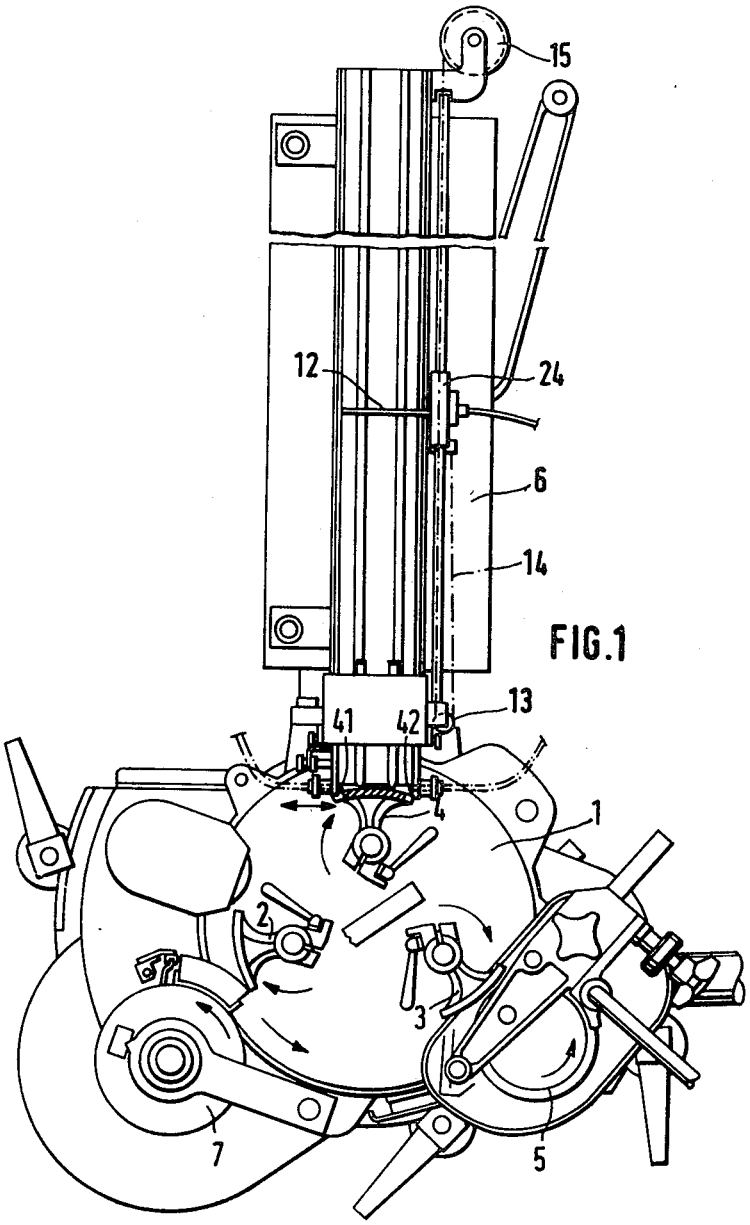

The invention is a labeling station for articles like bottles that has at least one pivoting or swiveling extractor with a pickup surface that is convex and coated with an adhesive and that rocks over or rolls across the front of a stack of labels in a magazine, the adhesive picking up one label at a time from the stack, which is held in place by holders that grip its side, and the pickup surface having recesses for the holders so that it can rock unimpeded across the front of the stack.

The hook-shaped holders in a known labeling station of this type extend only slightly over the front of the stack edge so that the adhesive on the pickup surface of the extractor will always enable it to pick up the front label of the stack. The retentive force generated by the hooks can however hardly keep the stack of labels in place in a label magazine that moves between a primary, forward position and a secondary, retracted position. This motion is necessary because the extractor in such a labeling machine must remove a label from the stack only when it is to be transferred to an article. If there is a gap in a series of articles to be labeled, a detector in the controls will detect the absence and move the magazine that contains the labels from the forward to the retracted position where the extractor can no longer contact the surface of the stack and is therefore unable to remove a label. The magazine will have to be moved back into the forward position again before the next label can be picked up. These back-and-forth motions can only occur between two pickups. In a labeling station that has, for example, three extractors on a rotating mount and a capacity for labeling 50,000 articles per hour, the time between the beginning of one pick up and that of the next is only a fraction of a second. Since part of this time is devoted to the actual pickup, only the time between the end of one pickup and the beginning of the next is left over for the label magazine to move back and forth. The length of this time will vary in accordance with the type of labeling machine. Since, however, the amount of time left over for the magazine to move will in any case be short, the stack of labels, which is positioned loosely in the magazine, will be subjected to powerful accelerating forces. These accelerating forces, added to the inertia of the rather massive stack, will cause it to float in the magazine. Clean label removal can not be guaranteed when the pickup surface of the extractor rocks over the front of the stack of labels. The front of the stack may even start to peel off. Finally, the rapid motion and the large mass to be moved require a powerful drive mechanism that is subjected to high loads.

In another type of labeling stations in which the magazine is stationary, the extractor does not rock over the front of the stack of labels but has a fixed axis of rotation and is associated with only one edge of the stack. Since the extractor does not rock over the front of the stack, the labels are not "peeled off" but pulled out. It is however possible to employ a holder on the opposite edge, which applies pressure on the front of the stack and has a coating with a high coefficient of friction, to keep labels from being pulled out. Since such an extractor is a roller and, with its fixed axis of rotation, will cover only the area at one edge of the stack, enough room will be left for the holder on the opposite edge. Label removal can be initiated or stopped just by regulating the pressure with which the holder presses on the front of the stack (DD Pat. No. 123 659)

The present invention is intended as a labeling station of the type initially described that will ensure faultless removal of labels from the stack when the series of articles is intact and suspension of the process when there are gaps and that will function even under the most difficult labeling conditions, as when the labels are delicate or when output is high.

In a labeling station of the type initially described, the invention accomplishes this objective in that the holders or supplementary holders are moved from an initial inoperative position into a second position, before the front of the stack of labels, in which they exert pressure on the stack and are movable, the recesses or additional recesses in the pickup surface being designed with respect to the holders in the second position to allow the pickup surface to rock unimpeded, and in that the drive mechanism that moves the holders has controls that prevent it from moving them in accordance with the rocking motion of the pickup surface only in the intervals between removals.

It is no longer necessary to move the magazine to comply with the "no bottle-no label" condition. The holders prevent a label from being released from the stack even when the pickup surface rocks completely over the front of the stack of labels. There will never be a collision with holders that extend only slightly or even relatively far over the edge either in the initial or in the second position because, on the one hand, the pickup surface has recesses and, on the other, the holders will move from the initial into the second position only during the intervals between removals. Since the mass of the holders to be moved is very small in comparison with the mass, also to be moved, of the magazine and stack of labels, the drive mechanism required to move them can be very inexpensive. The holders can be moved very rapidly for the same reason. This means that it will be very easy to satisfy the "no-bottle-no label" condition even at very high output.

When labels are removed by advancing the holders, with the magazine remaining motionless, it will generally be impossible to avoid getting adhesive on the front of the stack unless the holders force the stack back far enough in the magazine. Adhesive on the front of the stack when removal is inhibited will in any case not be critical when label removal will again be possible during one of the next contacts, and especially during the next contact, of the pickup surface with the front of the stack. Since, however, the controls will at times detect the absence of not just one, but of several bottles, from the series, it will be practical to make the magazine movable, with a drive mechanism that will move it out of the forward position into a retracted position. Whereas, at state of the art, the magazine must move during the intervals between label removals and hence very rapidly, the magazine in the invention can move more slowly because of the holders that impede label removal. For this reason the controls coordinate the drive mechanism that moves the magazine out of the front and into the rear position and vice versa with the drive mechanism that moves the holders so that the magazine drive mechanism will be inhibited only when the holders are in the second position, before the front of the stack. If several bottles are detected missing from the series to be labeled, the holders will immediately be activated and prevent further label removal. The magazine will then move back out of its front position into its retracted position. This motion may occur slowly because the holders will already have blocked label removal. Soon enough before label removal resumes, the magazine will move into the forward position with the holders still activated. As soon as the stack of labels come to rest after this motion, the holders will be released immediately before the next removal, allowing the next label to be removed. The known floating of the stack within the magazine because of the motion of the magazine will no longer have a negative effect on label removal. As soon as label removal is possible again, the front of the stack will be in a defined position.

In another embodiment of the invention the movable holders are on the front and rear edge of the stack in relation to the rocking motion and the front holders can be controlled independently of the rear holders. This embodiment makes it possible to control the front or rear holders even while the pickup surface is still rocking over the rear or front edge. This not only extends the intervals between removals, but also allows two extractors to work on the stack at the same time, with one removing a label while the second is prevented from removing a label by the previously positioned holders. This situation is especially likely to occur when there are a lot of extractors on one mount and relatively long labels are being processed.

The amounts of time available for controlling the extractors can, however, also be extended by significantly curtailing the times they take to rock over the stack. Shorter rocking times can be achieved for example with a labeling station in which the sense in which the extractors rotate or pivot when rocking over the stack is the opposite of the direction in which the mount and gripper cylinder turn. Such a labeling station will result in high output even when the mount has fewer extractors, so that there will be more time to control them between label removals.

The holders can be pins that slide in guides and with ends that in the retracted initial position overlap the edge of the stack to an extent that still permits label removal. The supplementary holders can as an alternative be pins that slide forward or arms that pivot and that overlap the edge of the stack only when activated. When the supplementary holders are pivoting arms, they should overlap the original holders, which will allow the recesses in the pickup surface that are not covered with adhesive to be minimized.

The labels can be removed by increasing the retentive force of the extractors while leaving the position of the front of the stack unchanged as well as by making it possible to force back the front of the stack with the sliding pins or pivoting arms at least at its front edge in relation to the rocking motion of the extractor with respect to the nominal label-removal position.

In this case the holders ensure that the stack is compacted, reliably preventing label displacement even when contact of the extractor with the stack is initiated. It is the front edge, which is just the point that receives the most stress, that is protected. When the rear holders, and possibly upper and lower holders as well, can be preadjusted, the front of the stack as a whole can be forced back into a position in which the extraction force will be so low that the extractor will no longer touch the front of the stack at all. In this case, the motion of the device that thrusts the pins forward will have a component directed toward the stack or the pins will be conical.

A slide to which pressure is applied toward the open front of the stack and that supports it from the side will prevent the stack from floating inside the magazine as the result of its back-and-forth motion if the slide has an adjustable clamp, stop, or similar device activated by the controls in accordance with the motion of the magazine from the forward into the rear position but before reaching the rear position and from the rear position into the forward position but before leaving the rear position. The controls should release the blocking action of the clamp, stop, or similar device only after a certain delay that will at least equal the time taken by the magazine to move between the two positions. If, indeed, the magazine is in the rear position and if it is to be loaded with fresh labels in that position, the clamp or stop will have to be released before the labels can be loaded.

The labeling station will preferably also have a stop that prevents displacement of the labels, that back-grips them inside the magazine on the side facing its open front and moves along with them towards the front, and that can be blocked off with an adjustable lock mechanism inside the magazine. Such a stop will support the labels in the magazine. When the magazine moves out of the forward and into the rear position and brakes suddenly upon reaching the rear position, the inertia of the labels will prevent them from continuing the motion. The motion of the magazine from the rear position into the forward position on the other hand will be directly transferred to the labels. In this case as well, they will not remain in that position but will immediately move forward.

Force will be applied to the labels toward the open front of the magazine as a rule by a slide that back-grips them on the side facing the front. In one embodiment of the invention the slide and the stop can be the same device.

The lock mechanism can be blocked off on a track that runs along the length of the magazine and that is mounted on it.

A friction lock mechanism is appropriate. Such a lock mechanism can continuously block the stop along the length of the magazine. The stop can easily change position inside the magazine by pivoting around or sliding along, or both, an axis that is parallel to the longitudinal axis of the magazine. The stop will preferably be attached to the lock mechanism. It will be especially necessary for the stop to slide along the longitudinal axis of the magazine when there are two magazines, one on top of the other, and the bottom magazine does not have enough room.

A piston and cylinder is an appropriate mechanism for powering the magazine and the bolt in the lock mechanism.

Figure 2:
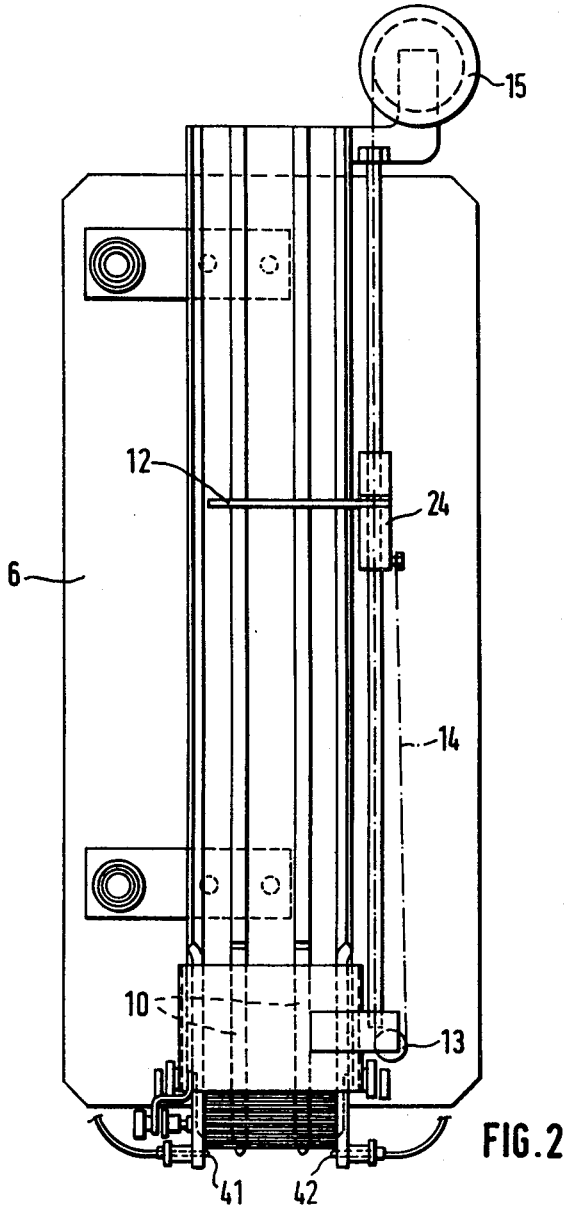
Figure 3:
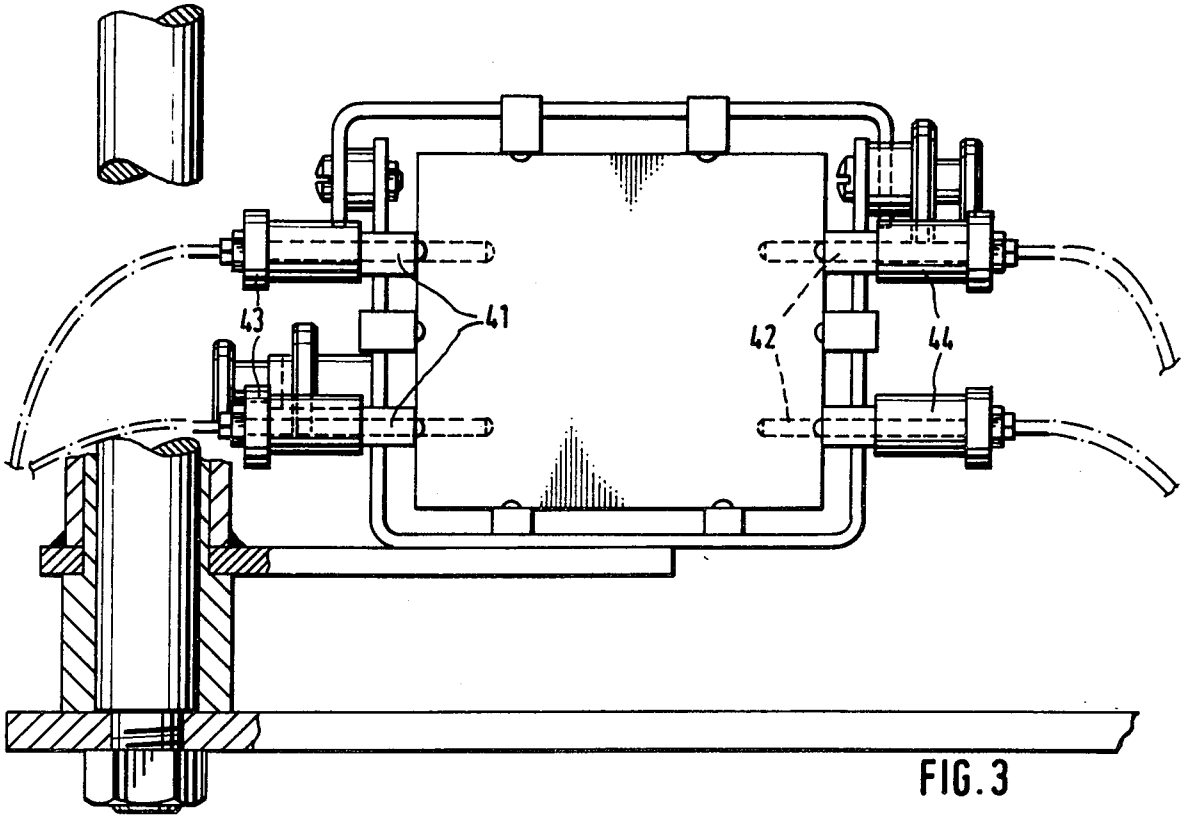
Figure 4:
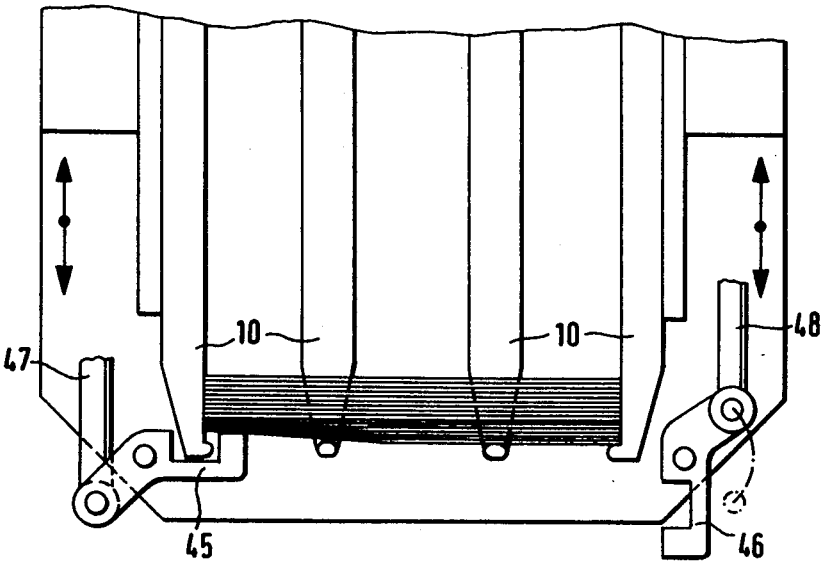
Figure 5:
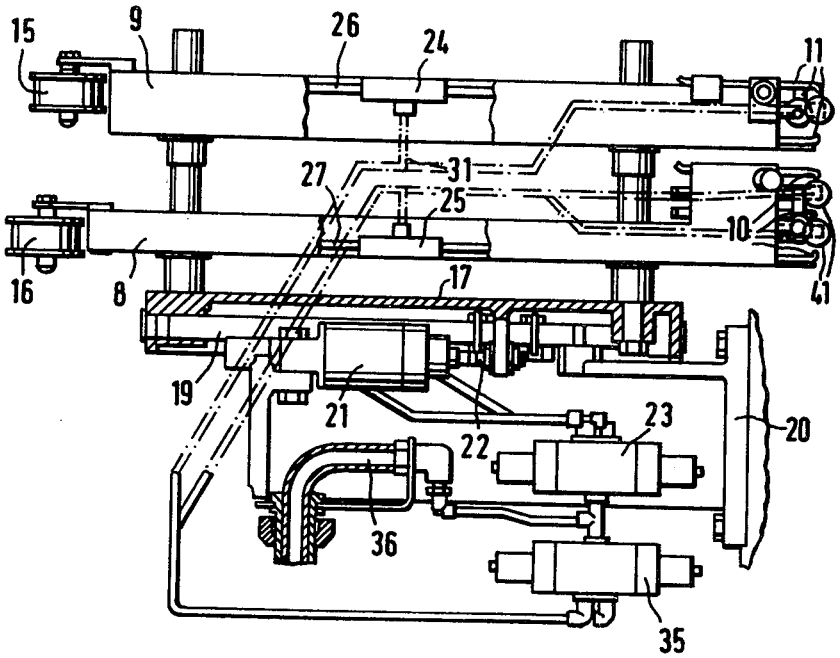
Figure 6:
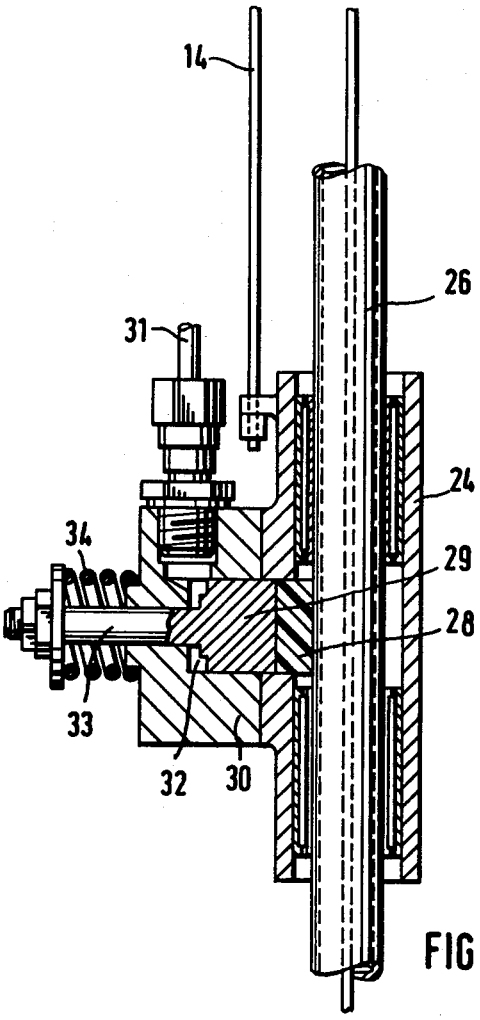
Figure 7:
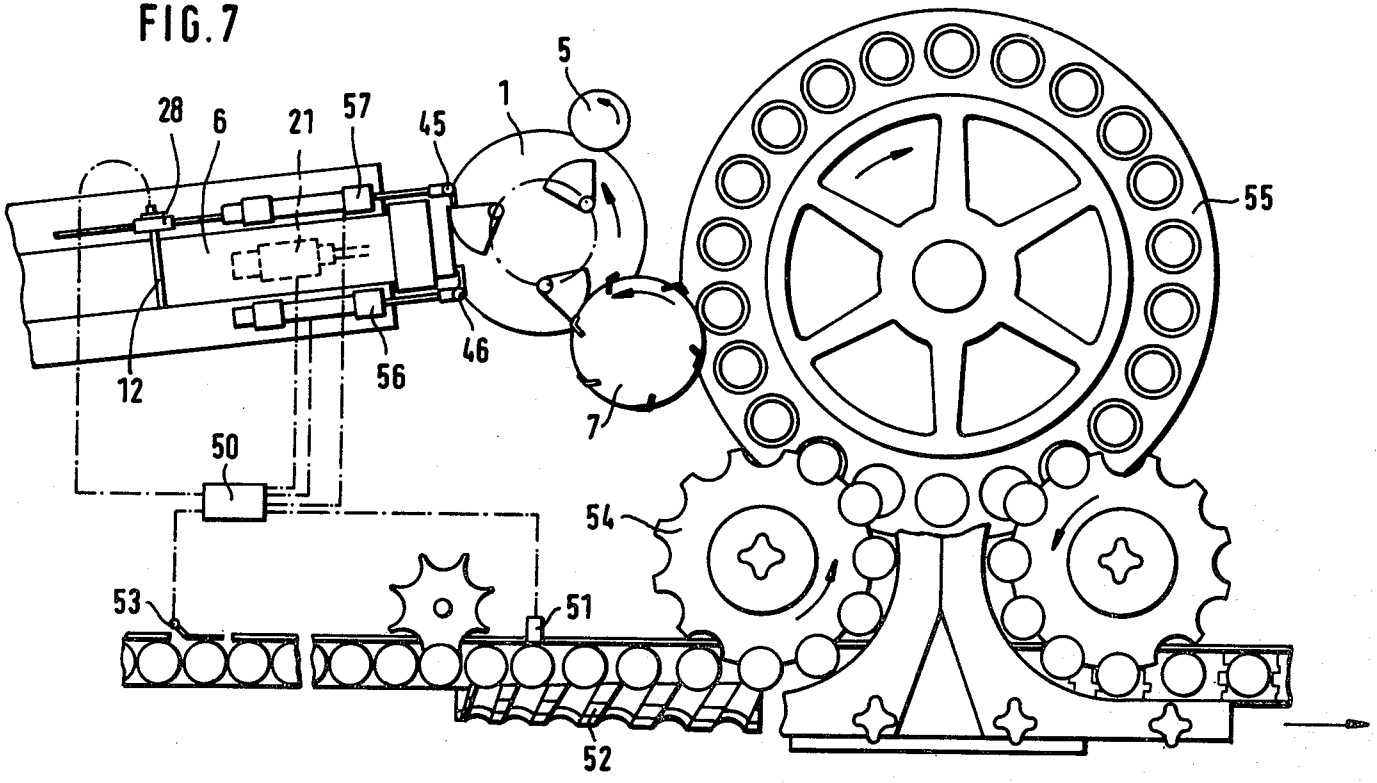

The invention will now be described with reference to the drawings, which illustrate one embodiment and in which FIG. 1 is a schematic top view of a labeling station in a labeler with a label magazine that can be moved back and forth, FIG. 2 is a larger-scale top view of the magazine in FIG. 1, FIG. 3 is a large-scale front view of the magazine in FIGS. 1 and 2, FIG. 4 is a top view of the front of a different version of the magazine in FIGS. 1 through 3, FIG. 5 is a side view of the magazine in FIG. 1 with its drive mechanism, FIG. 6 shows the locking mechanism for the slide on the magazine in FIG. 5, and FIG. 7 is a schematic top view of a labeling machine with the labeling station illustrated in FIGS. 1 through 6.

The labeling station illustrated in FIG. 1 consists of a rotating mount 1 that carries three rotating or oscillating label extractors 2, 3, and 4, and of a rotating adhesive roller 5, a label magazine 6, and a rotating gripper cylinder 7. The geometry and operation of such a labeling station are known U.S. Pat. No. 4,092,207).

In such a labeling station the curved pickup surface of extractors 2 through 4 rocks or rolls against various points, specifically against the adhesive roller 5, where adhesive is applied to it, over the front of the stack of labels in magazine 6, removing a label from the stack in the process, and against gripper cylinder 7 onto which it releases the label obtained from the stack. When a label is to be removed from the stack, magazine 6 is in the forward position illustrated. When, however, the extractor is not intended to remove a label, magazine 6 is retracted so that the pickup surface of extractors 2 through 4 can not rock against the front of the stack. This prevents label removal.

The magazine 6 illustrated in the drawing consists of two boxes 8 and 9, one positioned above the other, one for body labels and one for neck labels. Boxes 8 and 9 are open at the top and rear so that they can be loaded with stacks of labels from the top or rear. At the front of boxes 8 and 9 are label guiderails 10 and 11 with hooks that point inward and retain the stack. The labels can be removed with extractors 2 through 4. The labels are moved forward by flat slides 12 that extend into boxes 8 and 9 between the labels and that are forced individually forward by tensioning mechanisms 14 that travel over a deflection pulley 13. Tension is applied by a windup pulley 15 and 16 that is itself tensioned by a helical spring.

Boxes 8 and 9 are mounted on a common carrier 17 that slides along a track 19. Track 19 is mounted on a bracket 20 on the bed of the machine. Bracket 20 also supports a piston-and-cylinder drive mechanism 21 with a moving piston rod 22 that is coupled to carrier 17. Piston-and-cylinder drive mechanism 21 can be loaded from either side. It is controlled through a valve 23. This drive mechanism moves magazine 8 and 9 back and forth over track 19.

The slide 12 in each box 8 and 9 is angularly rigid but slides along a slot across the longitudinal axis of the magazine on a bushing 24 or 25 that rotates on and slides along a tubular track 26 or 27. Bushing 24 has a radial bore in which a bolt 28 is nonrigidly mounted. When pressure is applied to bolt 28 in the direction of tubular track 26, the bolt blocks bushing 24 on the track.

Pressure is applied to bolt 28 from a piston-and-cylinder mechanism that consists of a piston 29 on the face of which bolt 28 is mounted and of a cylinder housing 30 connected to bushing 24. Pressure medium can be supplied to piston chamber 32 through a line 31. A spring 34 and tie rod 33 mechanism retracts piston 29 and hence bolt 28 from tubular track 26 when the piston is uncharged, allowing bushing 24 to slide freely along the track.

Pressure medium is supplied over line 31 through a control valve 35. The two control valves 23 and 35 have a common supply line 36.

The large scale diagrams of the label magazine in FIGS. 2 and 3 show only the lower box. In addition to the hooked guiderails 11 that operate as holders at the front, there are four supplementary holders, pins 41 and 42, two at the front and two at the rear of the stack, that can be moved from an initial position, in which they overlap the edge of the stack to exactly the same extent as the hooks on guiderails 11, into a second position, represented by the broken lines. Pins 41 and 42 travel in piston-and-cylinder mechanisms 43 and 44 and are moved forward against the force of a built-in spring.

Instead of pins 41 and 42 that move back and forth, the supplementary holders can also be pivoting arms with recesses for, and overlapping, the hooks and coupled by rods 47 and 48 to drive mechanisms like piston-and-cylinder mechanisms.

Controls 50 that include a detector 51, which detects the absence of a single bottle from the series of bottles being labeled as they travel by a separating worm 52, and a flow sensor 53, which senses a gap of several bottles as they travel along a conveyer, coordinate the various motions of label magazine 6, bolt 28, and holders 41, 42, 45, and 46.

Since the number of bottles forwarded by worm 52 through feed star 54 to gripper cylinder 7 on bottle turntable 55 is fixed and since the individual components 52, 54, 55, 7, and 1 are synchronized, label removal can be inhibited whenever a gap in the series of bottles is detected. The controls are connected to the machine in such a way as to inhibit label removal at the correct instant. Controls 50 govern drive mechanisms 56 and 57, holders 45 and 46, and the mechanism 21 that drives label mechanism 6 and bolt 28 in accordance with signals from detector 51 and sensor 53.

When the controls do not receive a signal from either the detector or the sensor and when the magazine is in the forward or removal position, bolt 28 will only be subjected to the force of spring 34 and bushing 29 will be able to slide freely on tubular track 26. Since holders 45 and 46 will not be activated, the extractors will be able to remove labels.

When, on the other hand, detector 51 detects the absence of one bottle from the series, controls 50 will activate mechanisms 56 and 57. Activation will, however, not become effective immediately but as a function of the throughflow rate of the bottles, which ensures that gripper cylinder 7 will not accept a label when it encounters a gap on turntable 55. When sensor 53 detects a gap of several bottles, not only drive mechanism 56 and 57 but also the mechanism 21 that drives magazine 6 and, if necessary, bolt 28 are activated. Mechanism 21, however, is not activated until holders 45 and 46 have been activated so that the stack of labels will not get displaced inside the magazine as the result of inertia as the magazine retracts. Bolt 28 can be activated simultaneously or as the magazine retracts. This is accomplished with valves 23 and 35, meaning that locking mechanism 24 or 25 will already be blocking the associated slide 12 on tubular track 26 or 27 before the magazine reaches the rear position. This ensures that, when magazine 6 brakes in the rear position, the labels will not shift backwards as the result of their inertia.

If detector 51 and sensor 53 determine that there is no gap in the series of bottles, magazine 6 will be moved forward again. This forward motion will occur precisely before the next desired label removal. Since holders 45 and 46 prevent removal, it does not matter if an extractor that is not supposed to remove a label contacts the stack of labels. Higher outputs are possible in any case because holders 45 and 46 are operating in conjunction with the controls that govern the moving label box so that the mass of the loaded magazine will no longer inhibit output. The mass of holders 45 and 46 is so slight that they can be moved rapidly even with small drive mechanisms.

A delaying link can be interposed between bolt 28 and controls 50 to ensure that blocking lasts throughout the actual motion of the magazine. Blocking can be discontinued subsequently so that slide 12 can be shifted for any subsequent loading of the magazine.

It will be understood that the specification and examples are illustrative but not limitative of the present invention and that other embodiments within the spirit and scope of the invention will suggest themselves to those skilled in the art.

I claim:

1. In a labeling station for articles like bottles comprising at least one pivoting or swiveling extractor with a pickup surface that is convex, means for coating the extractor with an adhesive, means for rocking the extractor over or for rolling it across the front of a stack of labels in a magazine, the adhesive picking up one label at a time from the stack, means holding the magazine in place and having a portion extending in front of the stack, the pickup surface of the extractor having recesses aligned with the portion of the holding means so that the surface can rock unimpeded across the front of the stack, the improvement wherein the holding means comprises means movable from a first inoperative position into a second position in front of the stack of labels for exerting pressure on the stack, wherein the recesses in the pickup surface are aligned with the pressure exerting means when in the second position to allow the pickup surface to rock unimpeded, and further comprising control means for moving the pressure exerting means between the first and second positions only in the intervals between removals.

2. A labeling station according to claim 1, wherein the retention force exerted by the pressure exerting means against the front of the stack of labels is more powerful than the force exerted by the extractor in removing a label.

3. A labeling station according to claim 1, wherein the control means includes a detector for gaps in the series of articles being supplied to the station, the control means moves the pressure exerting means only when a gap is detected.

4. A labeling station according to claim 1, including a drive mechanism for moving the magazine, the control means coordinating the action of the drive mechanism with the pressure exerting means so that the drive mechanism that moves the magazine will be inhibited only when the pressure exerting means is in the second position in front of the stack.

5. A labeling station according to claim 1, wherein the pressure exerting means is disposed on the front and rear edge of the stack in relation to the rocking motion, the control means including means for controlling the front holders independently of the rear holders.

6. A labeling station according to claim 1, wherein the pressure exerting means comprises pins that slide in guides and with ends that in the retracted first position overlap the edge of the stack to an extent that still permits label removal.

7. A labeling station according to claim 1, wherein the pressure exerting means comprises supplementary holding means comprising pins that slide forward or arms that pivot and that overlap the edge of the stack only when activated.

8. A labeling station according to claim 1, further comprising means for forcing back the front of the stack comprising sliding pins or pivoting arms at least at its front edge in relation to the rocking motion of the extractor with respect to the nominal label-removal position.

9. A labeling station according to claim 1, including a rotating gripper cylinder to which the label is transferred, each extractor being mounted eccentrically with respect to its convex pickup surface on a rotating mount, the direction in which the extractor rocks or rolls being opposite the direction in which the mount and the gripper cylinder rotate, at least while a label is being removed.

10. A labeling station according to claim 1, including means for retracting the magazine, the pressure exerted by the pressure exerting means on the front of the stack of labels being greater than the inertia of the stack in the movable magazine as it retracts.

11. A labeling station according to claim 10, wherein the control means activate the means for retracting the magazine so as to retract it only after the pressure exerting means have been activated.

12. A labeling station according to claim 11, including a slide for urging the stack towards the extractor and adjustable clamp means activated by a control in accordance with the motion of the magazine from a forward into a rear position but before reaching the rear position and from a rear position into a forward position but before leaving the rear position to block the movement of the slide.

13. A labeling station according to claim 12, including means permitting the control to release the blocking of the clamp means only after a certain delay that will at least equal the time taken by the magazine to move between the two positions.

14. A labeling station according to claim 12, wherein the blocked slide back-grips the labels inside the magazine on the side of the slide facing the open front of the magazine, and normally moves along with the labels towards the front, the clamp means including an adjustable lock mechanism inside the magazine.

15. A labeling station according to claim 14, wherein the slide has an adjustable stop which is attached to the lock mechanism.

16. A labeling station according to claim 14, including means for retracting the magazine, a bolt activating the lock mechanism, and piston-and-cylinder mechanisms for powering the magazine retracting means and the bolt.

17. A labeling station according to claim 14, wherein the blocked slide that back-grips the labels on the side facing the open front of the magazine in order to apply pressure to them toward the front functions as a stop.

18. A labeling station according to claim 17, wherein the slide is mounted so as to be pivotable around or slidable along, or both, an axis that is parallel to the longitudinal axis of the magazine, thereby to change the position of the slide inside the magazine.

19. A labeling station according to claim 14, including a track that runs along the length of the magazine and is mounted on it, the lock mechanism being capable of being blocked off on the track.

20. A labeling station according to claim 19, wherein the track and lock mechanism are a guide for the slide.

* * * * *